US010899024B2

(12) United States Patent
Duey

(10) Patent No.: US 10,899,024 B2
(45) Date of Patent: Jan. 26, 2021

(54) SAFETY FOR ASSIST OPENING KNIFE

(71) Applicant: Benchmade Knife Co., Inc., Oregon City, OR (US)

(72) Inventor: Wes Duey, Oregon City, OR (US)

(73) Assignee: Benchmade Knife Co., Inc., Oregon City, OR (US)

( * ) Notice: Subject to any disclaimer, the term of this patent is extended or adjusted under 35 U.S.C. 154(b) by 136 days.

(21) Appl. No.: 15/844,383

(22) Filed: Dec. 15, 2017

(65) Prior Publication Data

US 2019/0184584 A1 Jun. 20, 2019

(51) Int. Cl.
*B26B 1/04* (2006.01)
*B25F 1/04* (2006.01)

(52) U.S. Cl.
CPC ..... *B26B 1/048* (2013.01); *B25F 1/04* (2013.01)

(58) Field of Classification Search
CPC ..... B26B 1/048; B26B 1/046
USPC ..... 30/153, 155–161
See application file for complete search history.

(56) References Cited

U.S. PATENT DOCUMENTS 4,535,539 A 8/1985 Friedman et al.
5,596,808 A 1/1997 Lake et al.
5,822,866 A 10/1998 Pardue
5,964,036 A 10/1999 Centofante
6,591,504 B2 7/2003 Onion
6,675,484 B2 1/2004 McHenry et al.
7,032,315 B1 † 4/2006 Busse
7,062,857 B1 * 6/2006 Nenadic ..... B26B 1/042 30/161
7,140,110 B2 11/2006 Lake
7,305,768 B2 12/2007 Hinderer
7,437,822 B2 10/2008 Flagg et al.
(Continued)

FOREIGN PATENT DOCUMENTS

CN 101468466 A 7/2009
CN 203510249 U 4/2014
(Continued)

OTHER PUBLICATIONS

Extended European Search Report for European Patent Application No. 18212561, dated May 14, 2019, European Patent Office (EPO).†

*Primary Examiner* — Andrea L Wellington
*Assistant Examiner* — Liang Dong
(74) *Attorney, Agent, or Firm* — Schwabe Williamson & Wyatt, P.C.

(57) ABSTRACT

A folding tool with a safety lock mechanism. The tool has a handle having a first handle half and a second handle half and an implement pivotally connected between the handle halves by a pivot pin. The implement is movable between an open position and closed position. The safety lock mechanism includes a safety switch positioned between the first handle half and the second handle half and having two wing portions extending laterally from a central portion movable from a first safety on position to a second safety off position. The two wing portions configured to slide within wing grooves of the first handle half and the second handle half. The tang portion of the blade includes a scalloped pocket and/or protruding portion in the tang that is configured to contain the front end of the safety switch when the safety switch is in the first safety on position.

21 Claims, 9 Drawing Sheets

(56) References Cited

U.S. PATENT DOCUMENTS

| | | | | |
|---|---|---|---|---|
| 7,596,870 | B2 | 10/2009 | Klecker et al. | |
| 7,698,821 | B2 | 4/2010 | Ralph | |
| 7,941,927 | B1 | 5/2011 | Demko | |
| 7,979,990 | B2 | 7/2011 | Hawk et al. | |
| 8,413,338 | B2 | 4/2013 | Freeman | |
| 9,259,845 | B2 | 2/2016 | Gringer et al. | |
| 9,737,997 | B1 | 8/2017 | Marfione et al. | |
| 9,908,245 | B1 * | 3/2018 | Tkachenko | B26B 1/048 |
| 2004/0158991 | A1 | 8/2004 | Freeman | |
| 2007/0169351 | A1 | 7/2007 | Steigerwalt | |
| 2010/0192381 | A1 | 8/2010 | Sakai | |
| 2011/0010947 | A1 * | 1/2011 | Freeman | B26B 1/048 30/159 |
| 2015/0352730 | A1 * | 12/2015 | Duey | B26B 1/046 30/159 |
| 2016/0136824 | A1 | 5/2016 | Glesser | |

FOREIGN PATENT DOCUMENTS

| | | | |
|---|---|---|---|
| CN | 105073350 | A | 11/2015 |
| TW | 200914222 | A2 | 4/2009 |
| WO | WO20140130905 | A2 | 8/2014 |

* cited by examiner
† cited by third party

SAFETY FOR ASSIST OPENING KNIFE

TECHNICAL FIELD

The present disclosure relates to folding tools, and more particularly, to a folding tool having a safety lock that prevents the unwanted deployment of a blade that opens with a spring activated assist.

BACKGROUND

Folding knives are invaluable tools that are used in many aspects of everyday life. There are many types and styles of folding knives. A "manual" folding knife is a traditional type of tool in which the blade is manually movable by the user between a closed or stowed position in which the sharp edge of the blade is held safely within the handle, and an open position in which the blade is extended in an operable position. Certain folding knives include mechanisms that assist in the deployment of the blade. These assist opening knives allow a user to easily deploy the blade with one hand. Many folding knives also include mechanisms that lock the blade in the open position, primarily as a safety feature.

BRIEF DESCRIPTION OF THE DRAWINGS

Embodiments will be readily understood by the following detailed description in conjunction with the accompanying drawings and the appended claims. Embodiments are illustrated by way of example and not by way of limitation in the figures of the accompanying drawings.

DETAILED DESCRIPTION OF DISCLOSED EMBODIMENTS

Figure 1:
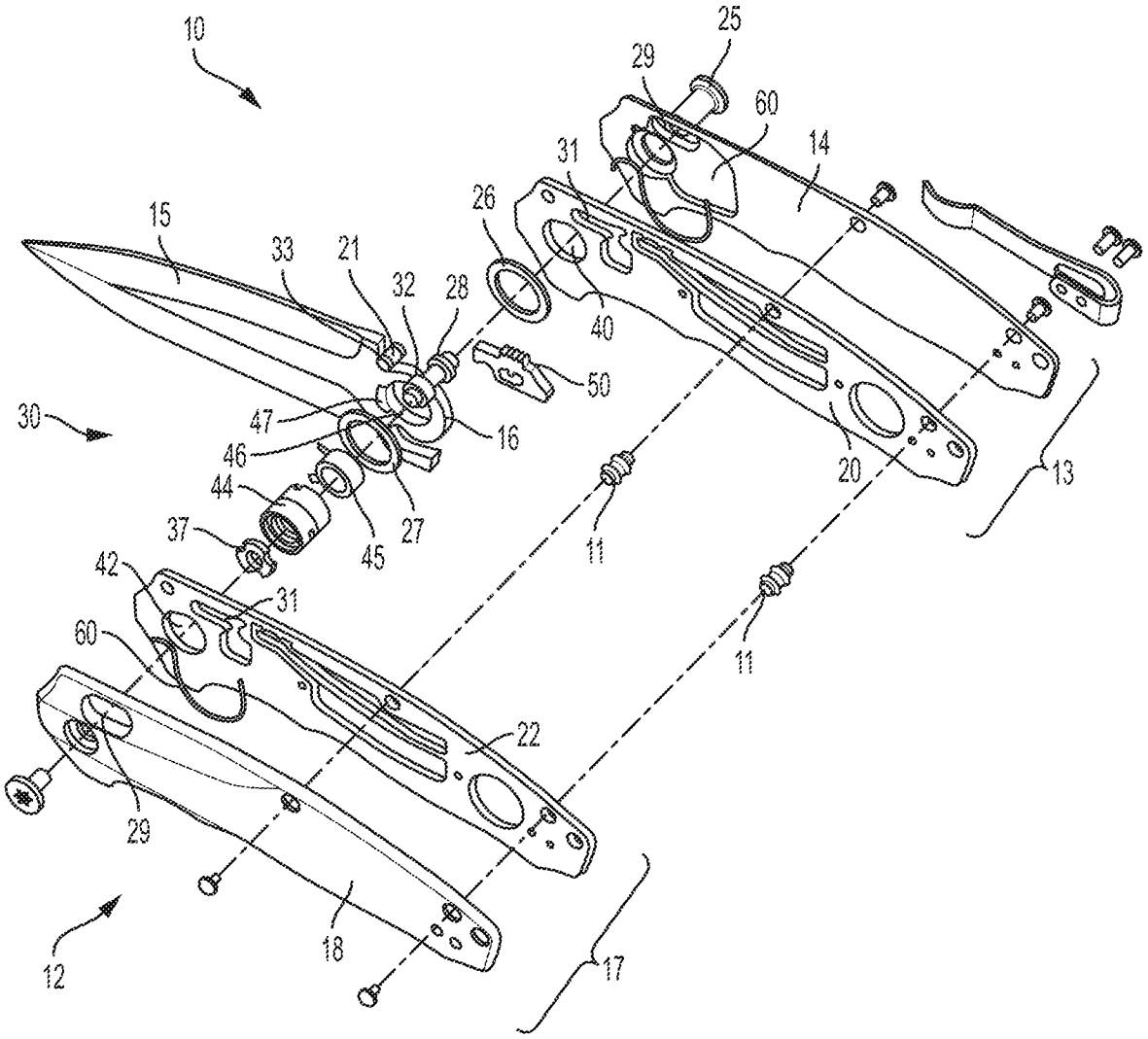
FIG. 1 is a perspective and exploded view of a folding knife having a safety lock mechanism that keeps the blade from being inadvertently deployed, in accordance with various embodiments.

In the following detailed description, reference is made to the accompanying drawings, which form a part hereof, and in which are shown by way of illustration embodiments that may be practiced. It is to be understood that other embodiments may be utilized and structural or logical changes may be made without departing from the scope. Therefore, the following detailed description is not to be taken in a limiting sense, and the scope of embodiments is defined by the appended claims and their equivalents.

Various operations may be described as multiple discrete operations in turn, in a manner that may be helpful in understanding embodiments; however, the order of description should not be construed to imply that these operations are order dependent.

The description may use perspective-based descriptions such as up/down, back/front, and top/bottom. Such descriptions are merely used to facilitate the discussion and are not intended to restrict the application of disclosed embodiments.

The terms "coupled" and "connected," along with their derivatives, may be used. It should be understood that these terms are not intended as synonyms for each other. Rather, in particular embodiments, "connected" may be used to indicate that two or more elements are in direct physical contact with each other. "Coupled" may mean that two or more elements are in direct physical contact. However, "coupled" may also mean that two or more elements are not in direct contact with each other, but yet still cooperate or interact with each other.

For the purposes of the description, a phrase in the form "A/B" or in the form "A and/or B" means (A), (B), or (A and B). For the purposes of the description, a phrase in the form "at least one of A, B, and C" means (A), (B), (C), (A and B), (A and C), (B and C), or (A, B and C). For the purposes of the description, a phrase in the form "(A)B" means (B) or (AB) that is, A is an optional element.

The description may use the terms "embodiment" or "embodiments," which may each refer to one or more of the same or different embodiments. Furthermore, the terms "comprising," "including," "having," and the like, as used with respect to embodiments, are synonymous, and are generally intended as "open" terms (e.g., the term "including" should be interpreted as "including but not limited to," the term "having" should be interpreted as "having at least," the term "includes" should be interpreted as "includes but is not limited to," etc.).

With respect to the use of any plural and/or singular terms herein, those having skill in the art can translate from the plural to the singular and/or from the singular to the plural as is appropriate to the context and/or application. The various singular/plural permutations may be expressly set forth herein for sake of clarity.

Opening assist mechanisms have been incorporated into folding knives for some time (see, for example, U.S. Pat. Nos. 7,748,122 and 8,171,645). Typically with a knife that incorporates an opening assist mechanism, the blade is retained in the closed position without the need for a trigger to deploy the blade. Instead, the opening assist function is provided by a spring that operates to deploy the blade. As the user manually rotates the blade from the closed position toward the open position, the spring mechanism reaches a threshold point, after which the spring drives the blade to the open or deployed position. Such knives are extremely useful for single handed operation, where a simple flick of the fingers or thumb deploys the knife blade. However, in a knife that includes an opening assist mechanism for safety reasons it is important that the blade stays in the closed position until the user volitionally and intentionally causes the blade to be deployed to the open position. Thus, there is a continual need for new and/or improved safety lock mechanisms for an opening assist knife. The present disclosure meets this need.

The present disclosure relates to a folding tool having a safety lock mechanism that prevents or inhibits the deployment of an implement, such as a knife blade, when the safety feature is engaged, that is in the "safety on" position. In certain embodiments, the folding tool is a folding knife and the implement is a knife blade. In certain embodiments, the disclosed tool includes a locking mechanism (for example, an AXIS® lock as described in U.S. Pat. No. RE 41,259, which is hereby incorporated herein by reference in its entirety) that securely locks the blade in the open extended position. In embodiments, the disclosed tool includes an open assist mechanism, for example as disclosed in U.S. Pat. Nos. 7,748,122 and 8,171,645, which are hereby incorporated herein by reference in their entirety.

As disclosed herein, the folding tool includes a safety lock mechanism that effectively prevents the blade from being accidently deployed when the safety lock is in the closed, safety on, position, and the blade is in the closed position. One of the unique features of the disclosed safety lock mechanism is that it is configured so that the blade can be actively closed while the safety lock is in either the on, locked, position or the off, unlocked, position. In other words, the safety lock mechanism can be engaged when the blade is open and does not interfere with the action of closing the blade. These and other features are especially important for a knife with an assisted deployment mechanism to prevent the unwanted deployment of the blade, while still allowing for safe and easy one handed operation of the knife, either to open the blade or close the blade.

Aspects of the current disclosure relate to a folding tool, such as a folding knife, that includes a safety lock mechanism that prevents the unwanted deployment of an implement, such as a knife blade. In embodiments, the folding tool includes a handle having a first handle half and a second handle half held in a spaced apart relationship, for example to form an implement groove for accepting the implement in the closed position. In embodiments, the implement is pivotally connected between the first handle half and the second handle half by a pivot pin and the implement is movable between an open position and closed position by rotation about this shaft. The implement, such as a knife blade, includes a tang and a working portion, for example the sharpened portion of a knife. As disclosed herein, the folding tool further includes a safety lock mechanism that prevents the unwanted deployment of the implement.

While designed specifically for knives having an open assist mechanism, it is noted that the safety lock mechanism disclosed herein could be used for other knives, including manual and/or fully automatic knives. In embodiments, the safety lock mechanism includes a safety switch positioned between the first handle half and the second handle half. The safety switch has central portion with a front end, a rear end, a top side, a bottom side, and is movable from a first safety on position to a second safety off position, for example by sliding back and forth between the two handle halves. In embodiments, the safety switch includes two wing portions extending laterally from the central portion. In embodiments, the two wing portions are configured to slide within two opposing wing grooves that are on the two interior and facing sides of the first handle half and the second handle half, respectfully. Typically the individual handle halves are made from a liner and a sidewall, with the liner in the interior and the side wall on the exterior of the handle. However, it is contemplated that each handle half may be made as a single unitary element. In embodiments, the safety switch is configured to interact with a portion of the implement tang to prevent the implement from opening when the safety switch is in the safety on position. In certain embodiments, this tang includes a scalloped pocket or indentation that, when the implement is in the closed position, is in proximity to the front end of the safety switch such that the front end of the safety switch resides at least partially within this scalloped pocket or indentation and thereby prevents rotation of the implement from the closed position towards the open position.

Alternatively or additionally, the tang may include a small protrusion that extends from the tang and that, when the implement is in the closed position, is in proximity to the front end of the safety switch such that the front end of the safety switch prevents rotation of the implement from the closed position toward the open position. In certain embodiments, the front end of the safety switch includes a front surface and a bumper. In embodiments, the tang portion includes the flipper, which is extended from the remainder of the tang and provides a lever for activation of the assist mechanism. In embodiments, the flipper includes a scalloped pocket and/or a protruding portion separated from the sharpened part of the blade by a choil. When the safety switch is in the locked safety on position, the bumper sits in the scalloped pocket and rotation of the blade from the closed position to the open position is prevented by the protruding portion running or bumping against the front surface of the safety switch. This interaction effectively prevents the unwanted deployment of the blade. In embodiments, the scalloped pocket and/or the protruding portion provide a stop to accommodate a bumper and front surface of the safety switch. The safety lock mechanism thus ensures that a knife will not accidently open. With respect to a knife in the safety on position the front end of the safety blocks the blades rotation keeping it closed. However, when the safety is moved to the safety off position the blade can be opened. Typically the opening of the blade would be accomplished by a separate motion from moving the safety switch to the off position.

In certain embodiments, the safety lock mechanism includes a force producing member that retains the safety switch within the wing grooves and prevents unwanted movement of the safety switch, for example by applying pressure that makes unwanted or unassisted movement of the safety switch difficult. In embodiments, the force producing member comprises a spring, such as a compression spring or a leaf/cantilever spring. In embodiments, the spring is a leaf/cantilever spring and is made as a unitary body with the liner. With respect to the wings of the safety switch, in embodiments, each of the two wings include an upper guide surface and a lower guide surface that allow the wings to slide back and forth and position the wings within the wing grooves.

Figure 5A:
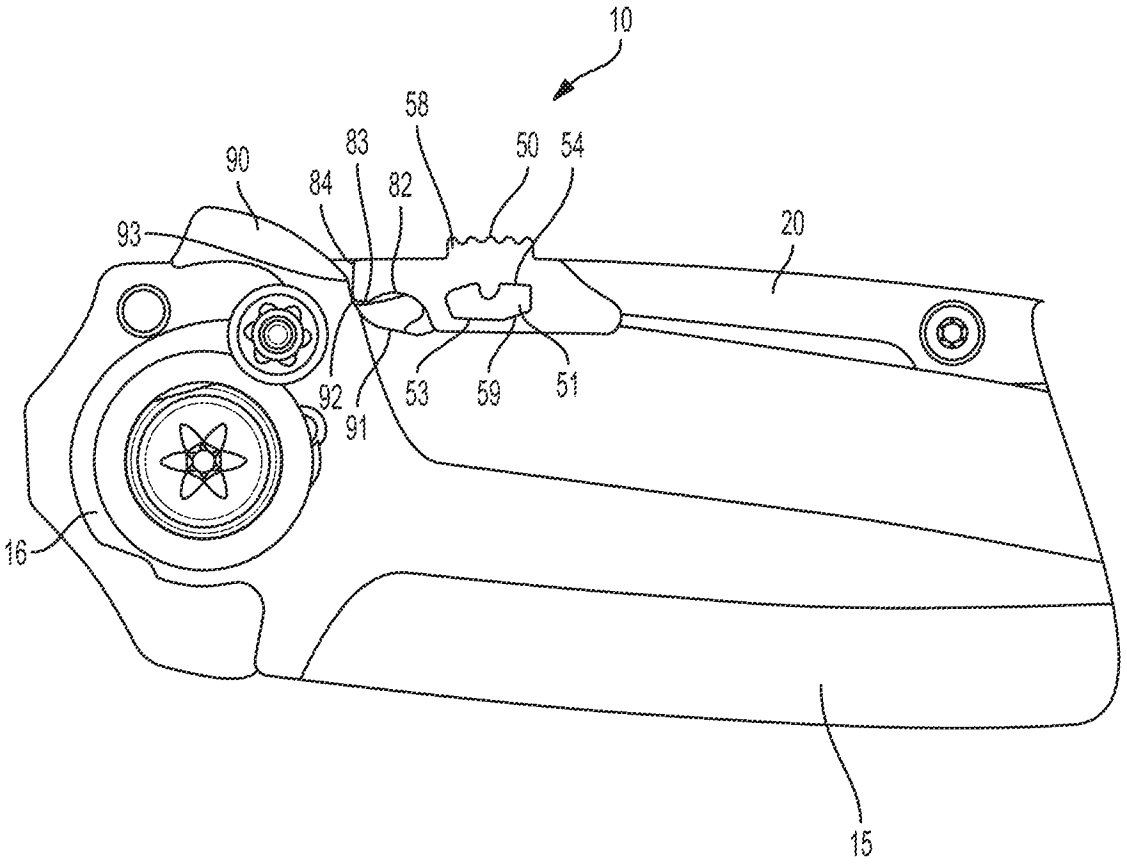
FIG. 5A is a cross sectional view of the knife shown in FIG. 2 in a partially assembled condition with the blade in a closed position with the safety switch in the on, locked position, in accordance with various embodiments.
Figure 5B:
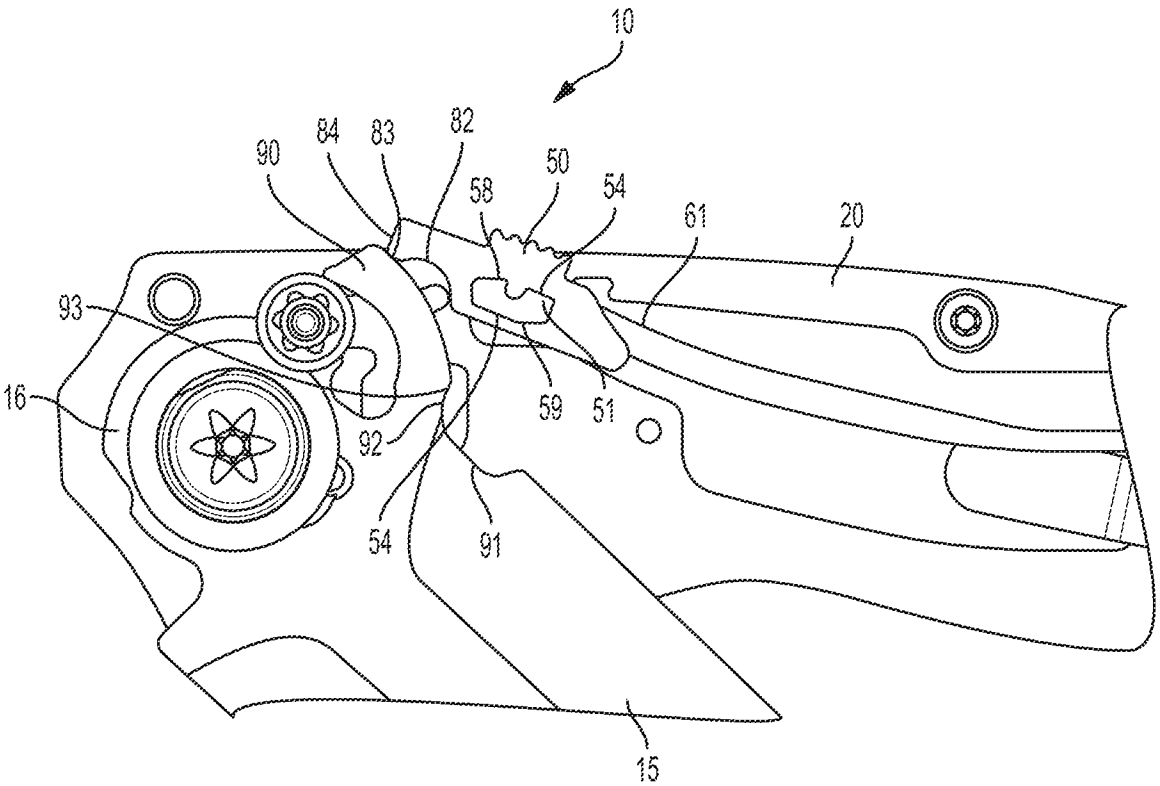
FIG. 5B is a cross sectional view of the knife shown in FIG. 2 in a partially assembled condition with the blade in a partial open position as the blade is being transitioned from the open, extended position to the closed position with the safety switch in the on, locked position, in accordance with various embodiments.
Figure 5C:
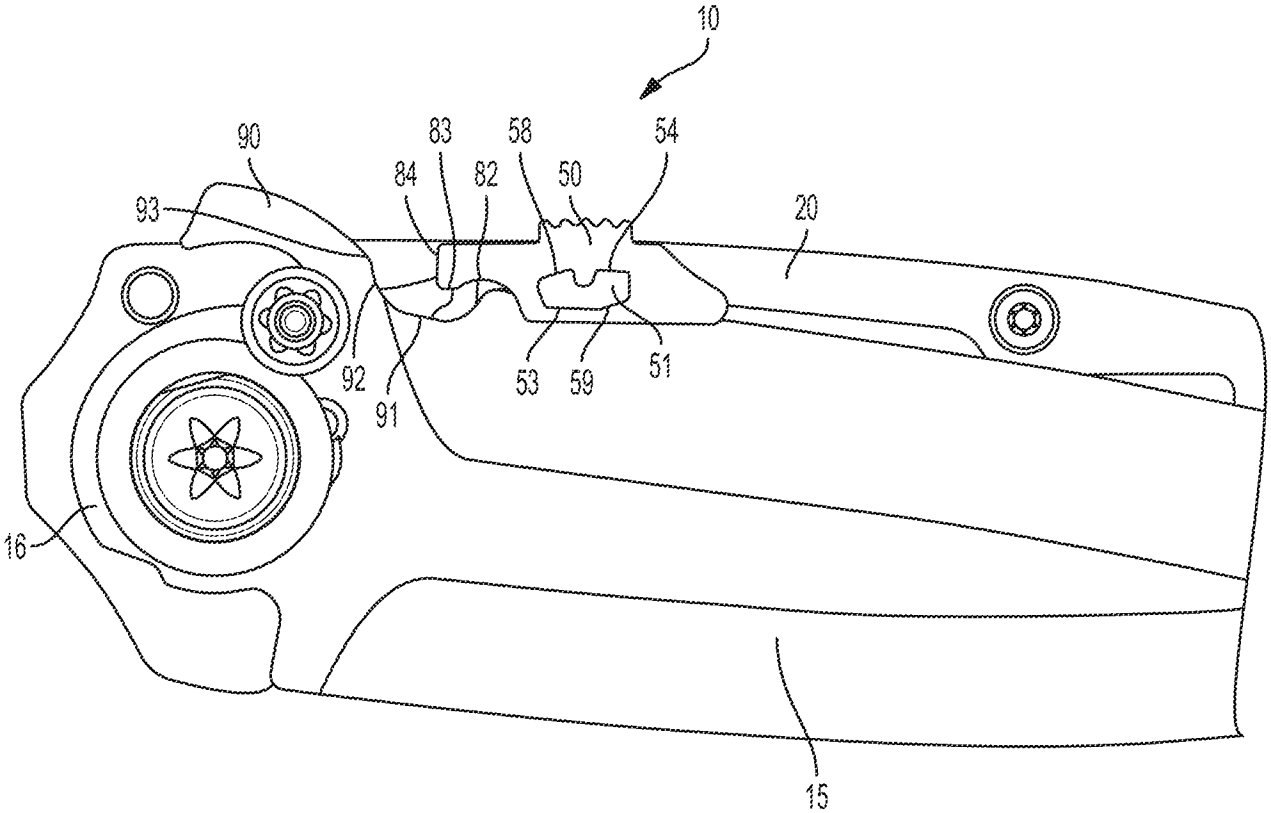
FIG. 5C is a cross sectional view of the knife shown in FIG. 2 in a partially assembled condition with the blade in closed position with the safety switch in the off, unlocked position, in accordance with various embodiments.

One of the unique features of the safety lock mechanism disclosed herein is that the safety switch can be moved to the safety on position when the implement is open without preventing the closing of the implement (see, for example FIGS. 5A-5C). This is accomplished by configuring the safety switch to pivot vertically with respect to the knife handle when the safety switch is in the safety on position as the implement is closed, for example moved from an opened position to a closed position. Once the implement is fully closed, the safety switch returns to the safety on position. In certain embodiments, each of the two wings includes a front ramped surface and a rear ramped surface wherein the front ramped surface and the rear ramped surface are configured to allow the safety switch to rotate about the wings in response to an upward pressure on the front end of the safety switch. In embodiments, the front ramped surface and the rear ramped surface are substantially parallel.

In certain embodiments, the safety switch can be indexed or retained in the safety on and/or safety off position, such that the switch must be manually moved from one to the other and will not accidently slide. In certain embodiments, this retention is made possible by the inclusion of indexing cavities in the top of the wings and corresponding indexing teeth on or within the wing grooves. In such a situation, the safety switch is positioned in the locked or unlocked position by the indexing teeth interacting with the indexing cavity. Typically, some downward pressure must be applied to overcome the force of the force producing member, which applies constant upward pressure on the safety switch, before the wings can be moved over the indexing teeth.

In certain embodiments, the central portion of the safety switch includes a central channel on the bottom side separating two side rails, wherein the central channel is configured to accept the working end of the blade when in the closed position. In embodiments, the two wings are coupled to the two side rails. In embodiments, the safety switch includes a thumb actuation surface that extends outward from the handle of the folding tool. In embodiments, the tool includes an opening assist mechanism. In embodiments, the opening assist mechanism includes a cylindrical sleeve disposed about the pivot pin and a torsion spring disposed within the cylindrical sleeve and about the pivot pin. In embodiments, the folding tool includes a lock bar that is movable between a first position and a second position, wherein the first position locks the implement in an open position, and moving the lock bar to the second position releases the implement from being locked in the open position. In embodiments, the lock bar is biased to the first position by one or more springs. In embodiments, the tang includes a first ramped surface that interacts with the lock bar in the open position.

With reference now to the drawings, a folding knife 10 having a closed blade safety lock as disclosed is illustrated in FIGS. 1 through 5C. In embodiments, the blade 15 can be locked in the open, extended position, for example using an AXIS® lock mechanism. The knife 10 further includes a safety lock mechanism that retains and locks the blade 15 in a closed position and prevents unwanted deployment of the blade 15 via an opening assist mechanism 30.

The folding knife 10 according to an embodiment of the present disclosure is shown in perspective exploded view in FIG. 1. As shown in FIG. 1 the folding knife 10 includes an elongate handle 12 that includes a first handle half 13 having a first sidewall 14 and an associated first liner 20 and a second handle half 17 having a second sidewall 18 with its associated second liner 22. The handle further includes spacers 11 disposed within handle 12 and between the first handle half 13 and the second handle half 17. A blade 15 is pivotally attached to the handle 12 between the first handle half 13 and the second handle half 17 at one end, referred to herein as the "forward" end of the handle 12. The blade 15 is pivotally movable about a blade pivot pin 25 between the open and closed positions along a blade plane. Other relative directional terms correspond to this convention: the "rear" or butt end of the handle 12 is opposite the forward end; the "upper" part of a blade is the dull, non-working portion and the "lower" part of the blade is the sharpened, working portion; "inner" or "inward" refers to the structural center of the knife, and so on. The X-Y plane is the plane parallel to the plane of the handle 12 and blade 15. The blade 15 travels in the X-Y plane as it is rotated between the closed and open positions. The Z plane is the plane transverse to the X-Y—the blade pivot pin 25 extends longitudinally in the Z-plane. To allow for smooth movement of the blade 15, bushings 26 and 27 are disposed between the sides of blade 15, the first liner 20, and the second liner 22, and disposed about the pivot pin 25. In the embodiment shown, the knife 10 includes a locking mechanism. The locking mechanism of the knife 10 includes a lock bar 28 that extends transverse to the plane of the handle 12 and which has its opposite ends extending in slots 29 in sidewalls 14 and 18, which align operationally with paired slots 31 in liners 20 and 22. The lock bar 28 is spring loaded with two U or horseshoe-shaped lock springs 60, one such spring associated with each of liners 20 and 22 and positioned between the sidewalls 14 and 18 and their associated, adjacent liners 20 and 22. A first end of each lock spring is fixed to the associated liner and the second end of the lock spring is attached to the lock bar 28 so that the lock bar 30 is always driven in the "forward" direction by the springs—that is, in the direction from the handle 12 toward the tip of the blade 15 when the blade is in the open position. The lock bar 28 and the springs that act on the lock bar 28 lock the blade 15 in the open position, for example as shown in U.S. Pat. No. RE 41,259. When the blade 15 is fully open, e.g. in the open position, the lock bar 28 is driven forward and interacts with detent 32 of blade 15 to lock the blade open. An open blade stop pin 31 stops rotation of blade 15 in the open position, at which a shoulder 33 on the blade 15 and the open blade stop pin 21. The knife 10 further includes a safety lock mechanism, which includes portions of the blade tang 16, the liners 20 and 22, and a safety switch 50.

Figure 2A:
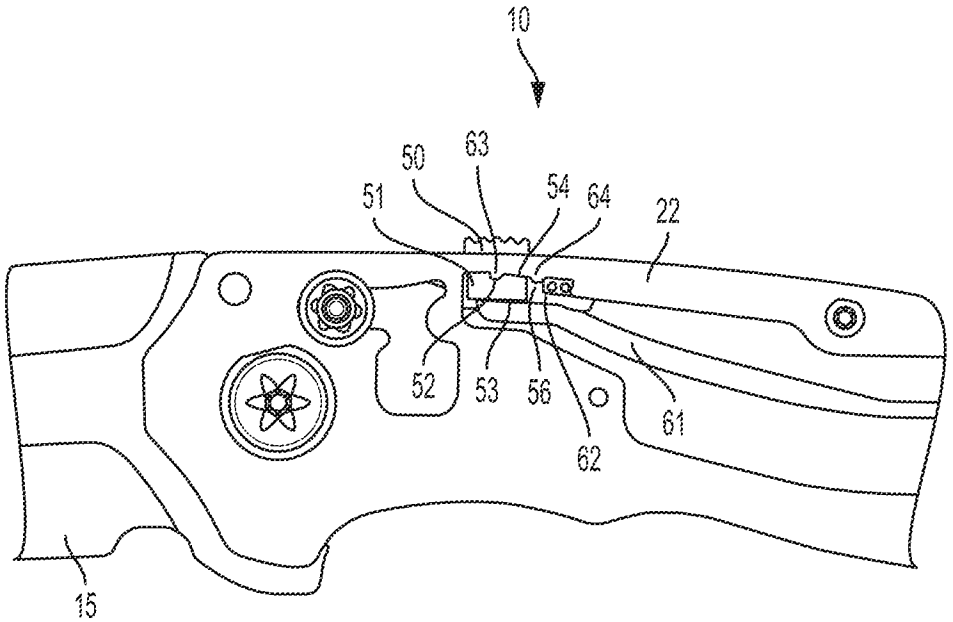
FIG. 2A is a side elevation view of the knife shown in FIG. 1 in a partially assembled condition with the blade in the locked, open, extended position and the safety switch in the on, locked position, in accordance with various embodiments.
Figure 2B:
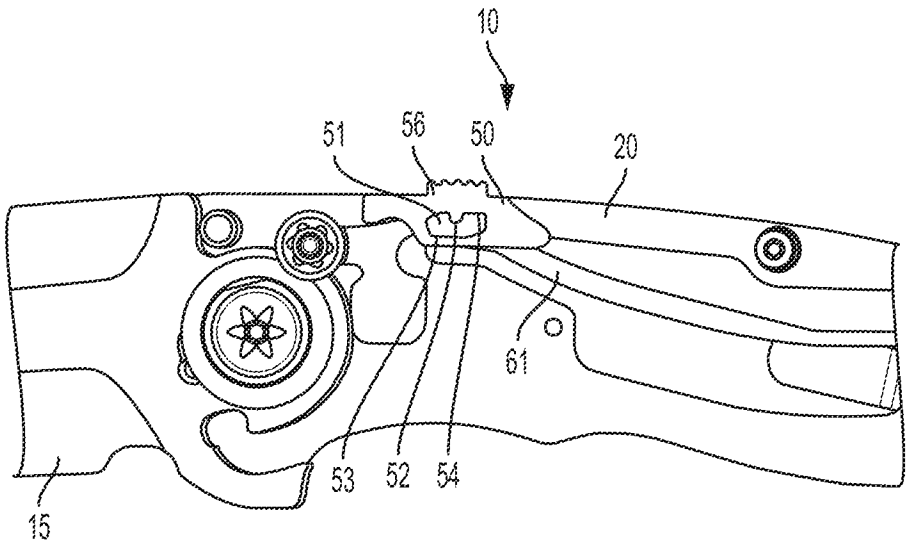
FIG. 2B is a side elevation view of the knife shown in FIG. 1 in a partially assembled condition with the blade in the locked, open, extended position and the safety switch in the on, locked position, in accordance with various embodiments.
Figure 3:
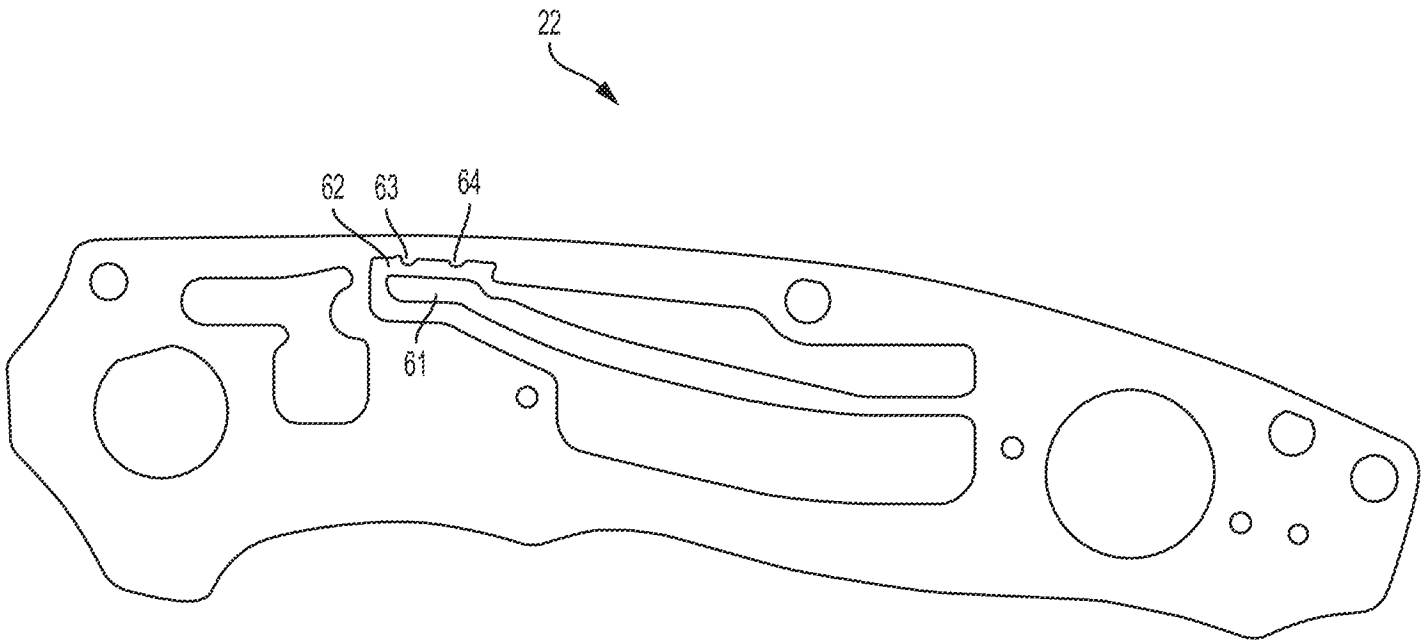
FIG. 3 is a side elevation view of a liner, in accordance with various embodiments.

Turning to FIGS. 2A-5C, the safety lock mechanism will be discussed as will the components making up the safety lock mechanism. FIG. 2A is a side elevation view of a partially constructed knife 10, showing the components of the safety lock mechanism, including the blade 15, the liner 22, and the safety switch 50 (the liner 20 would be behind the liner 22 and may include all of the features discussed, see FIG. 2B, which shows the components with liner 22 removed). As shown in FIG. 2A, the liner 22 includes the force producing member 61, in this case a leaf type spring, which drives the safety switch 50 upward. The safety switch 50 includes wings 51 (only one is visible) disposed on either side of the safety switch 50, which slides within a wing groove 62 of the liner 22. The central portion 56 rides between the two liners in the assembled knife. The wing 51 rides in the wing groove 62 present in the two liners. The wing groove 62 includes a front tooth 63 and a rear tooth 64, which act as place holders for the wing 51 in the locked and unlocked positions, respectively. The wing 51 includes a lower sliding surface 53 and upper sliding surface 54, that allow the safety switch 50 to move forward and backward within the wing groove 62. The wing 51 includes an indexing cavity 52 that is configured to receive one of the teeth 63 and 64, depending on whether the safety switch 50 is in the locked or unlocked position. The force producing member 61 is configured to provide force on the bottom sliding surface 53 of the closed blade lock safety switch 50 causing the upper sliding surface 54 and the indexing cavity 52 to engage with the front tooth 63 and the rear tooth 64. Thus, in order to the move the safety switch 50 from the closed position to the open position (or the other way around), the user pushes down on the top of the safety switch 50 and slides the safety switch 50 from one tooth to the other. For clarity, the liner 22 is shown in FIG. 3. As can be seen from FIG. 3, the gap or width of the wing groove 62 is less than when the wing is inserted, demonstrating the tension applied by the force producing member 61 when the wing is inserted. The wing groove 62 includes a front tooth 63 and a rear tooth 64, which act as place holders for the wing 51 in the locked and unlocked positions, respectively.

Figure 4A:
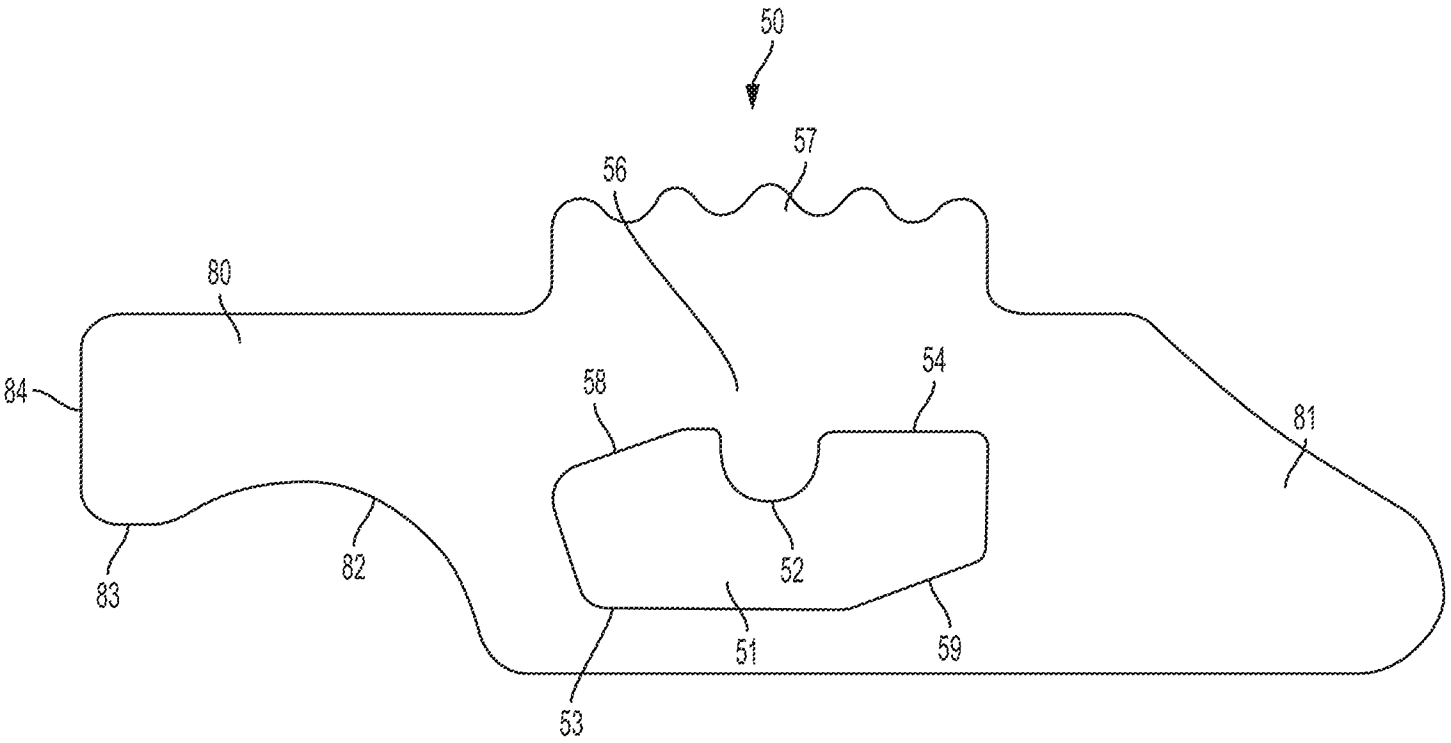
FIG. 4A is a side elevation view of a safety switch, in accordance with various embodiments.
Figure 4B:
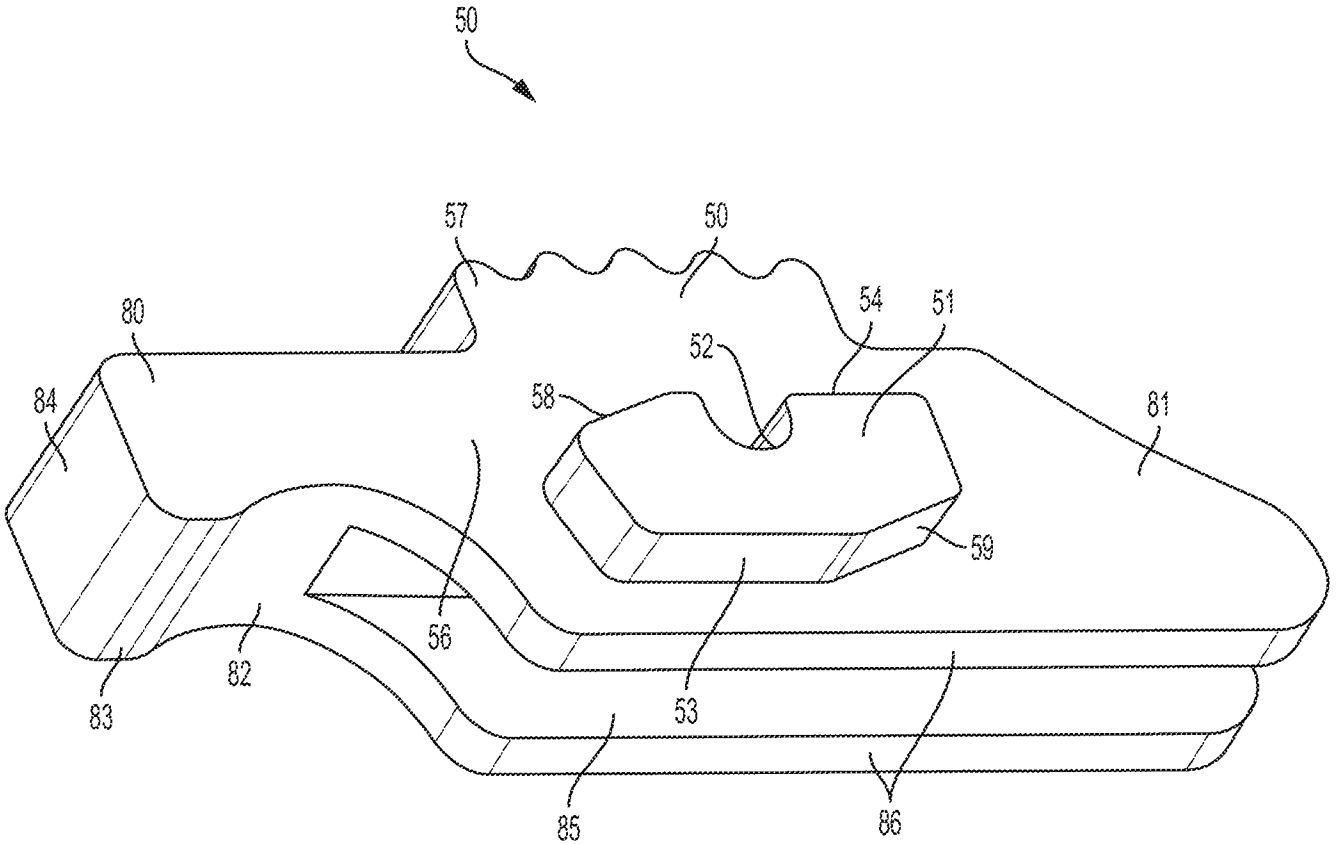
FIG. 4B is a perspective view of a safety switch, in accordance with various embodiments.

FIGS. 4A and 4B show the details of the safety switch 50. As described above, the safety switch 50 includes wings 51 having an indexing cavity 52 and disposed on either side of the central portion 56. The central portion 56 further includes a front end 80 and a rear end 81. In addition, the safety switch 50 includes a thumb actuation surface 57, that, in the assembled knife, protrudes from the knife handle so that a finger or thumb of a user can access the safety switch 50, for example, to slide the safety switch 50 back and forth between the locked to unlocked positions. The wing 51 includes several surfaces that are designed to allow the safety switch 50 to slide back and forth as well as rock when the knife blade is moved from the open position to the closed position while the safety switch 50 is in the closed, safety on position. As described above, the lower sliding surface 53 and the upper sliding surface 54 allow the safety switch 50 to move forward and backward within the wing groove. A forward ramped surface 58 and a rear ramped surface 59 are configured to allow the safety switch 50 to pivot within the wing groove and allow the front end 80 of the safety switch 50 to move upward, for example in response to rotation of the blade from the open position to the closed position when the safety switch is in the safety on position. This movement will be discussed in more detail below with respect to FIGS. 5A-5C. The front end 80 includes a front scalloped pocket 82, a bumper 83, and a front surface 84. These aspects of the safety switch 50 will be discussed further with respect to FIGS. 5A-5C. As best shown in FIG. 4B, the bottom of the central portion 57 includes a central channel 85 that separates two side rails 86. The central channel 85 and the rails 86 are configured so that the blade of the knife can slot into the central portion 57 when the blade is in the closed position. The two side rails 86 further provide a location for the attachment of the wing 51.

Turning now to FIGS. 5A-5B, the operation of the safety lock mechanism will be discussed. The mechanism is jointly composed of features of the blade 15, the liner 20, and the safety switch 50. FIG. 5A is a cross sectional view of the knife shown in FIG. 2 in a partially assembled condition with the blade 15 in a closed position with the safety switch 50 in the safety on, locked position. The tang portion 16 of the blade 15 includes several features that work in concert with safety switch 50 to provide a safety lock mechanism that helps to prevent the unwanted assisted deployment of the blade 15. As detailed above, the liner 20 provides the force to hold the safety switch 50 in position as well as a channel for its movement. The tang portion 16 includes the flipper 90, which is extended from the remainder of the tang and provides a lever for activation of the assist mechanism. The flipper 90 includes a scalloped pocket 92 and a protruding portion 93 separated from the sharpened part of the blade 15 by a choil 91. The scalloped pocket 92 and the protruding portion 93 provide a stop to accommodate the bumper 83 and the front surface 84 of the safety switch 50. When the safety switch 50 is in the locked safety on position, the bumper 83 sits in the scalloped pocket 92 and rotation of the blade 15 from the closed position to the open position is prevented by the protruding portion 93 running or bumping against the front surface 84 of the safety switch 50. This interaction effectively prevents the unwanted deployment of the blade 15. One of the unique features of the disclosed safety lock mechanism is that it can be set in the locked, safety on position while the blade is in the open extended position and still allows the blade to be closed. Furthermore, this locked safety position is maintained when the blade is closed. This is shown in FIG. 5B, which is a cross sectional view of the knife shown in FIG. 2 in a partially assembled condition with the blade 15 in a partial open position as the blade 15 is being transitioned from the open, extended position to the closed position with the safety switch 50 in the safety on, locked position. As the blade 15 transitions from the open extended position to the closed position, the flipper 90 pushes the bumper 82 upward causing the safety switch 50 to rotate about the wing 51. The wing 51 is allowed to rotate by virtue of the ramped surfaces 58 and 59. Once the blade 15 has fully rotated to the closed position (as shown in FIG. 5A), the bumper 83 slides back into the scalloped pocket 92 under pressure from the force producing element 61, where the blade 15 is now constrained from returning to the open extended position. FIG. 5C is a cross sectional view of the knife shown in FIG. 2 in a partially assembled condition with the blade 15 in closed position with the safety switch 50 in the off, unlocked position. In this position, it is evident that the bumper 84 is no longer in a position to inhibit the deployment of the blade 15.

Returning to FIG. 1, the open assist mechanism is shown generally with reference number 30. While the details of how such a mechanism operates will not be discussed at length herein, they can generally be found in U.S. Pat. Nos. 7,748,122 and 8,171,645, which are hereby incorporated herein by reference in their entirety. Briefly, a cylindrical sleeve 44 extends through a bore 40 formed in liner 20, and an aligned bore 42 formed in the liner 22. The cylindrical sleeve 44 also extends through aligned pivot bore 46 through tang portion 16 of blade 15. In the assembled knife 10, the cylindrical sleeve 44 is fitted snugly and fixedly through the pivot bore 46 in tang 16 of blade 15 so that the cylindrical sleeve 44 defines a rotational pivot axis for the blade extending transversely with respect to the plane of the blade 15 and the handle halves 13 and 17. Thus, sleeve 44 is axially aligned in the Z-direction—transverse to the X-Y plane. Disposed within the cylindrical sleeve 44 is torsion spring 45. At one end of the cylindrical sleeve 44, sleeve cap 37 fits within a groove of the cylindrical sleeve 44. One leg of torsion spring 45 fits within a groove in the cylindrical sleeve 44 while another leg of the torsion spring 45 fits within a recess 47 in the tang portion 16 of the blade 15.

Although certain embodiments have been illustrated and described herein, it will be appreciated by those of ordinary skill in the art that a wide variety of alternate and/or equivalent embodiments or implementations calculated to achieve the same purposes may be substituted for the embodiments shown and described without departing from the scope. Those with skill in the art will readily appreciate that embodiments may be implemented in a very wide variety of ways. This application is intended to cover any adaptations or variations of the embodiments discussed herein. Therefore, it is manifestly intended that embodiments be limited only by the claims and the equivalents thereof.

The invention claimed is:

1. A folding tool comprising:

a handle having a first handle half and a second handle half held in a spaced apart relationship to form an implement groove therebetween;

an implement pivotally connected between the first handle half and the second handle half by a pivot pin and movable between a fully open position and a fully closed position, the implement having a tang and a working portion;

a safety lock mechanism, comprising:

a safety switch positioned between the first handle half and the second handle half, the safety switch movable from a first safety on position to a second safety off position and having a central portion with a front end, a rear end, a top side, a bottom side, and two wings that extend laterally from the central portion such that the two wings slide within the wing grooves of the first handle half and the second handle half, wherein the safety switch is movable to the first safety on position when the implement is in the fully open position without preventing movement of the implement to the fully closed position while the safety switch remains in the first safety on position;

a protrusion in the tang that is configured to interact with the front end of the safety switch when the safety switch is in the first safety on position; and a force producing member that retains the safety switch, wherein the safety switch rotates about the wings in the wing grooves when the safety switch is in the first safety on position to permit the implement to be moved from the open position to the closed position while the safety switch remains biased to the first safety on position, and wherein the safety switch rotates back to the safety on position once the implement is in the closed position to prevent opening the implement.

2. The folding tool of claim 1, wherein the two wings each include an upper guide surface and a lower guide surface and wherein the upper and lower guide surfaces slide within the wing grooves.

3. The folding tool of claim 1, wherein the two wings each include a front ramped surface and a rear ramped surface and wherein the front ramped surface and the rear ramped surface are configured to allow the safety switch to rotate about the wings in the wing grooves in response to an upward pressure on the front end of the safety switch.

4. The folding tool of claim 1, wherein the tang further includes a scalloped pocket adjacent to the protrusion and wherein the front end of the safety switch is retained in the scalloped pocket when the safety switch is in the first safety on position.

5. The folding tool of claim 1, wherein the wings have an indexing cavity and the wing grooves have indexing teeth and wherein the safety switch is positioned in the locked or unlocked position by the indexing teeth interacting with the indexing cavity.

6. The folding tool of claim 1, wherein the central portion of the safety switch comprises a central channel on the bottom side separating two side rails, wherein the central channel is configured to accept the working portion of the implement when in the closed position.

7. The folding tool of claim 6, wherein the two wings are coupled to the two side rails.

8. The folding tool of claim 1, wherein the safety switch comprises a thumb actuation surface that extends from the handle of the folding tool.

9. The folding tool of claim 1, wherein the first handle half and the second handle half each comprise a sidewall and a liner, and wherein each liner has the force producing member coupled thereto.

10. The folding tool of claim 9, wherein the force producing member and the liner are a single integral piece of material.

11. The folding tool of claim 1, wherein the force producing member comprises a spring.

12. The folding tool of claim 11, wherein the spring comprises a leaf/cantilever spring.

13. The folding tool of claim 1, wherein the implement comprises a knife blade.

14. The folding tool of claim 1, wherein the tang comprises a flipper.

15. The folding tool of claim 1, further comprising an opening assist mechanism.

16. The folding tool of claim 15, wherein the opening assist mechanism comprises a cylindrical sleeve disposed about the pivot pin and a torsion spring disposed within the cylindrical sleeve and about the pivot pin.

17. The folding tool of claim 1, further comprising a lock bar that is movable between a first position and a second position, wherein the first position locks the implement in an open position, and moving the lock bar to the second position releases the implement from being locked in the open position.

18. The folding tool of claim 17, wherein the lock bar is biased to the first position by one or more springs.

19. The folding tool of claim 17, wherein the tang comprises a first ramped surface that interacts with the lock bar in the open position.

20. A folding tool comprising:

a handle having a first handle half and a second handle half held in a spaced apart relationship to form an implement groove therebetween;

an implement pivotally connected between the first handle half and the second handle half by a pivot pin and movable between a fully open position and a fully closed position, the implement having a tang and a working portion;

a safety lock mechanism, comprising:

a safety switch positioned between the first handle half and the second handle half, the safety switch movable from a first safety on position to a second safety off position and having a central portion with a front end, a rear end, a top side, a bottom side, and two wings that extend laterally from the central portion such that the two wings slide within the wing grooves of the first handle half and the second handle half, wherein the safety switch is movable to the first safety on position when the implement is in the fully open position without preventing movement of the implement to the fully closed position while the safety switch remains in the first safety on position;

a protrusion in the tang that is configured to interact with the front end of the safety switch when the safety switch is in the first safety on position; and a force producing member that retains the safety switch, wherein the central portion of the safety switch comprises a central channel on the bottom side separating two side rails, wherein the central channel is configured to accept the working portion of the implement when in the closed position.

21. The folding tool of claim 20, wherein the two wings are coupled to the two side rails.

* * * * *